US005305581A

United States Patent [19]

Reeves, Jr. et al.

[11] Patent Number: 5,305,581

[45] Date of Patent: Apr. 26, 1994

[54] AUTOMATED CONTAINER FILLING APPARATUS

[75] Inventors: Robert H. Reeves, Jr., Angleton; Randal Kretzler, Clute, both of Tex.

[73] Assignee: Velasco Scale Company, Freeport, Tex.

[21] Appl. No.: 15,634

[22] Filed: Feb. 9, 1993

[51] Int. Cl.[5] ..... B65B 3/28; B65B 7/28

[52] U.S. Cl. ..... 53/468; 53/471; 53/502; 53/75; 53/281; 53/381.4

[58] Field of Search ..... 53/468, 471, 473, 492, 53/281, 282, 367, 381.4, 75, 502, 492; 141/83, 171, 181

[56] References Cited

U.S. PATENT DOCUMENTS

| | | | |
|---|---|---|---|
| 3,540,181 | 11/1970 | Bowen | 53/367 X |
| 3,835,617 | 9/1974 | Stock et al. | 53/468 X |
| 3,932,979 | 1/1976 | Stock et al. | 53/381.4 X |
| 3,993,199 | 11/1976 | Jorgensen et al. . | |
| 3,994,351 | 11/1976 | Kesaree . | |
| 4,098,053 | 7/1978 | Shank | 53/367 X |
| 4,098,059 | 7/1978 | Chattillion | 53/367 X |
| 4,132,052 | 1/1979 | Larson | 53/381.4 X |
| 4,211,263 | 7/1980 | Kennedy et al. . | |
| 4,337,802 | 7/1982 | Kennedy et al. . | |
| 4,373,316 | 2/1983 | Kobayashi | 53/367 X |
| 4,494,583 | 1/1985 | Reeves, Jr. et al. . | |
| 4,703,780 | 11/1987 | Reeves, Jr. et al. . | |
| 4,735,238 | 4/1988 | Reeves, Jr. . | |
| 4,804,024 | 2/1989 | Arnemann | 53/381.4 X |
| 4,821,783 | 4/1989 | Arnemann | 53/381.4 X |
| 4,998,911 | 3/1991 | Reeves, Jr. et al. . | |

*Primary Examiner*—Horace M. Culver

*Attorney, Agent, or Firm*—Arnold, White & Durkee

[57] ABSTRACT

An automated apparatus and method for filling a container with a fluid. This apparatus is particularly well suited for the filling of relatively large containers of the type that utilize removable, threaded plugs for gaining access into the containers. For such containers, the apparatus can perform the tasks usually involved in the typical filling operation (e.g., aligning, opening, fluid dispensing, closing and sealing the container). Such automated tasks are especially relevant when dealing with fluids which are toxic, inclined to foaming or likely to mix readily with the surrounding gaseous environment. The apparatus includes a container transport system to coordinate the movement of a container between and its interaction with the following task oriented assemblies: bung alignment, kicker, bung cap handling, fluid dispensing, and sealing cap installation.

18 Claims, 8 Drawing Sheets

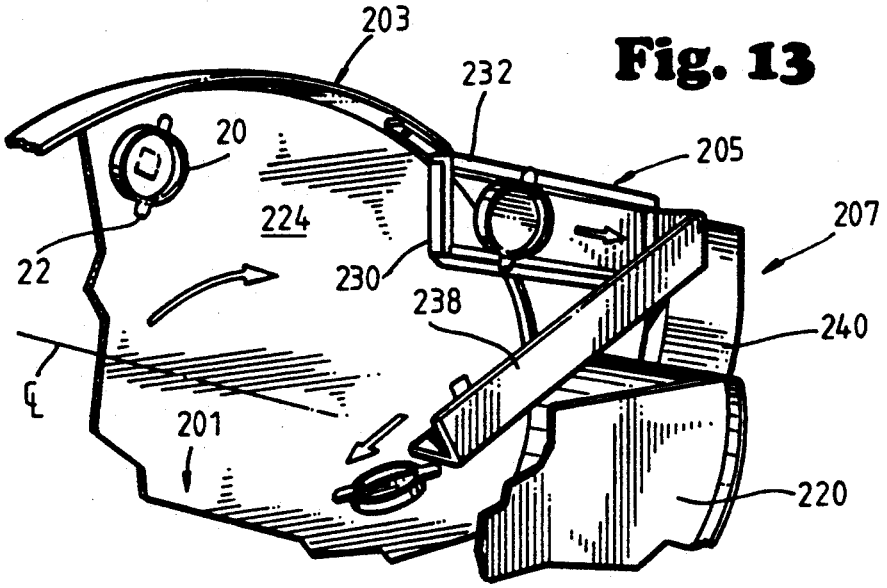
Fig. 13
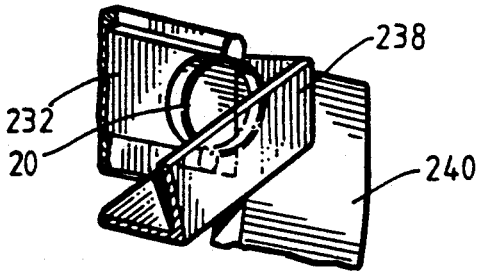
Fig. 14A
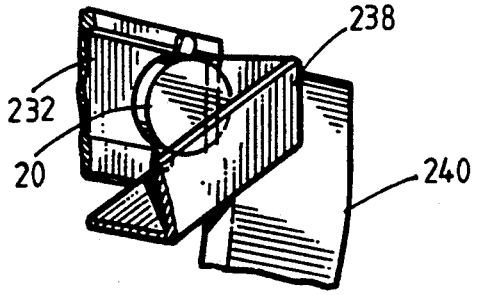
Fig. 14B
Fig. 15
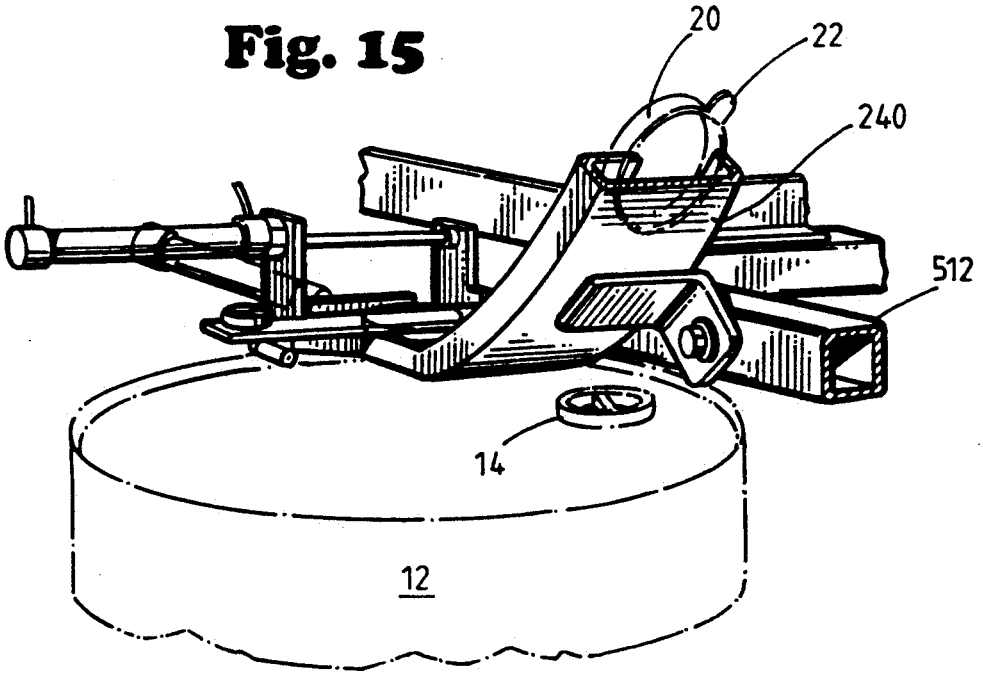

AUTOMATED CONTAINER FILLING APPARATUS

BACKGROUND OF THE INVENTION

1. Field of the Invention

This invention relates to an automated system for dispensing fluids into containers. The apparatus of this invention is particularly well suited to the filling of relatively large containers that utilize removable, threaded plugs for gaining access into the containers. More particularly, this invention is directed to an automated apparatus which can perform the tasks (e.g., aligning, opening, fluid dispensing, closing and sealing a container) usually involved in filling containers of the aforementioned type. Such automated tasks are especially relevant when dealing with fluids which are toxic, inclined to foaming or likely to mix readily with the surrounding gaseous environment.

2. Description of Related Art

In most facilities for dispensing fluids into relatively large containers (e.g., fifty-five gallon drums), the containers to be filled are conveyed by a suitable roller conveyor or like apparatus between a number of stations at which the various tasks involved in filling the container occur. For containers used for toxic or foaming fluids and which have their fluid receiving openings (i.e., bungs) closed or capped with covers (i.e., bung caps), these steps are exemplified by the following listing of possible container filling tasks: (1) positioning an empty container so that its bung is properly aligned for ease of handling at downstream stations, (2) removing the bung cap, (3) dispensing a predetermined amount of fluid into the container, often by employing a two step, fluid subsurface filling process which entails using a retractable fluid dispensing conduit, (4) closing the container by the insertion of a bung cap, and (5) covering the container's bung and bung cap with a protective sealing cap. Such filling steps and apparatus for performing each are disclosed in commonly assigned U.S. Pat. Nos. 4,211,263; 4,337,802; 4,494,583; 4,735,238 and commonly assigned U.S. patent application Ser. No. 07/901,807, said patents and patent application being hereby incorporated by reference.

Attainment of maximum facility output as measured by containers filled per unit time, potential operator manpower cost savings and fluid handling safety concerns make it advantageous for container filling machines such as those described above to be as automated and time efficient as possible. Progress towards these objectives can be seen in the disclosures of the previously incorporated, commonly assigned patents and patent applications.

SUMMARY OF THE INVENTION

This invention in a broad aspect comprises an improved container filling system. By utilizing fully automated sub-assemblies with closer working tolerances between their component parts, the system can both reduce the possibilities for fluid spillage and accomplish in a very time efficient manner the various tasks usually involved in a typical container filling operation (e.g., aligning, opening, fluid dispensing, closing and sealing the container).

In one particular aspect, the invention comprises an improved container alignment means which yields several significant benefits. It helps to shorten the time intervals necessary for a container to mate with the various automated assemblies involved in an overall filling operation. The improved alignment means also reduces misalignment problems which often result in the need to interrupt and halt a filling operation in order to correct such problems. Such improvements, in turn, contribute to increasing the operating efficiencies and effective output capacities of a container filling system.

Alignment improvements also allow the use of smaller working tolerances between the diameters of the bung and the fluid dispensing conduit which is used in filling the container. The use of these comparatively larger diameter conduits reduces fluid spillage and volatilization problems during the filling operation.

In still another aspect, the invention comprises a method for automatically filling containers in which a sequence of steps in a container filling process are automatically performed by specially designed assemblies whose actions are managed by an interconnecting control system.

The fluid filling apparatus of this invention automatically performs the tasks associated with filling relatively large containers (e.g., fifty-five gallon drums) of the type that utilize a removable, threaded plug (i.e., bung cap) for gaining access through a threaded opening (i.e., bung) into the container. The apparatus is arranged such that it takes the overall form of an automated assembly line. The apparatus is comprised of distinct assemblies which are oriented, such that they operate on a container in a sequential order as the container is transported between the assemblies by a suitable conveyor.

The apparatus includes a bung alignment assembly for locating and positioning a bung relative to the location of the downstream assemblies which must be properly mated with the bung in order to perform their various tasks. A special, so-called kicker assembly, functionally associated with the bung alignment assembly, provides a precise bung alignment which yields substantially improved overall operating efficiencies. Also included is a bung cap handling assembly for removing a bung cap prior to a fluid dispensing step. This step is accomplished by a fluid dispensing assembly which dispenses a predetermined amount of fluid into the container. Preferably a duplicate of the bung cap handling assembly is located further downstream to reinsert a bung cap into the container.

Finally, a sealing cap installation assembly is included for sealing the top of the container's bung with a sealing cap. This cap provides a protective seal which serves to minimize the amount of contamination which may otherwise fall into the container when its bung cap is removed, to protect the threaded inner surfaces of the bung, and to act as a security device to indicate when tampering with the bung and possible contamination of the contained fluid may have occurred.

According to one aspect of the invention, the bung alignment assembly preferably comprises means for rotating a container so that its bung is in approximate gross alignment for mating with the other assemblies of the apparatus. As described in previously incorporated by reference U.S. Pat. No. 4,494,583, container rotating means such as a driven roller means together with a bung sensing mechanism and a bung alignment control system may be used to provide this degree of bung alignment. As described in the referenced patent, the roller drive may be powered by suitable electrical or mechanical means such as an electric or pneumatic motor in response to a signal from the bung alignment control system. Although one embodiment has been described in the referenced patent it should be understood that other embodiments utilizing different sequencing of filling steps have been developed and will be described herein.

A kicker assembly, mentioned above, is coordinated with the bung alignment assembly to apply the necessary positional adjustments to yield precise alignment of the bung relative to the other assemblies of the apparatus. The kicker assembly includes a bung receiving tool which repositions the container into precise alignment with the bung cap handling and fluid dispensing assemblies. In a preferred form, the kicker assembly comprises a hydraulic piston driving a lever arm which contacts the upper sides of a container and operates in cooperation with the bung receiving tool to apply the motive force necessary to cause the bung to contact and be guided by the bung receiving tool into a desired precise alignment position.

The bung cap handling assembly includes a bung cap handling tool and a bung cap transfer arm. The tool is preferably mounted on a vertically movable platform which is situated above a container travel path between the various assemblies of the invention. On the platform is situated a rotatably mounted shaft having an alignment housing mounted on it. Also mounted on the shaft are means for engaging the specific type of bung cap used in the container. Means for removing a bung cap are engaged to the alignment housing. For containers utilizing screw-on bung caps, the bung cap removing means may include a suitable motor for rotating the shaft and the bung cap engaging means, thereby supplying sufficient torque to unscrew the bung cap. Mounted on the housing are means for retaining within the tool the unscrewed bung cap when the bung cap handling tool is raised to allow other assemblies of the apparatus access to the top of the container. Further details of this assembly are given in the previously incorporated by reference, U.S. Pat. No. 4,494,583.

According to one aspect of the invention, the fluid dispensing assembly includes a vertically movable conduit having a dispensing end for introducing fluid into a container. In one preferred embodiment of this invention a plurality of movable conduits are used in the same fluid dispensing assembly. This vertical movability feature of the conduit is especially relevant when dealing with the previously mentioned toxic, foaming or volatile fluids, since these fluids are often dispensed by surface filling techniques which require the use of a retractable conduit. The fluid dispensing assembly also includes a first signal generator or start mechanism for actuating the movement of the conduit from its raised position above a container and to a lowered position in which the dispensing end of the conduit is disposed just above the bottom of the container. As described in previously incorporated by reference U.S. Pat. No. 4,337,802, a control valve which is operable to introduce fluid at either a slow or fast flow rate is interposed between a fluid reservoir and the conduit.

It should be noted that the fast and slow flow rates are governed by the physical properties of the fluid (e.g., viscosity, toxicity, tendency to foaming) and the time requirements for filling the container. In a manufacturing situation this often means the shortest filling period possible. The slow flow rate is used when initially dispensing fluid into a container and until a predetermined fluid weight is achieved which typically corresponds to the lower end of the conduit being submerged in the fluid; then a switch is made to the fastest flow rate achievable consistent with the fluid's physical properties and safe work practices. The fluid dispensing assembly also includes a conduit location sensing mechanism and a second signal generator; these combine to control the fluid flow rate. When the fluid dispensing assembly is in the fast fill cycle the conduit (sometimes referred to as a "lance") is raised proportionately to the weight of fluid in the container. Preferably the dispensing tip of the conduit remains below the fluid level during the fast fill cycle. As the container nears filling a slow fill cycle is again actuated. In the preferred sequencing of this invention the conduit does not move during the second slow fill cycle. The conduit is then removed when the desired weight of fluid in the container has been achieved.

Also, a first preferred embodiment preferably included in the fluid dispensing assembly is a weight responsive device, such as a scale, which is adapted to generate control signals when the weight of fluid within the container reaches predetermined levels. The first control signal initiates the upward movement of the conduit, terminates the fast flow rate of fluid into the container and triggers a slow flow rate of fluid into the container. Finally, a third signal generator operates to produce a signal to stop the conduit at a predetermined position substantially withdrawn from the container but with the dispensing end of the conduit still submerged in the fluid. The second control signal terminates the slow flow rate of the fluid and actuates movement of the conduit back to its raised position.

In the most preferred embodiment of this invention the conduit is raised incrementally in response to the fluid weight in the container. The increments range from two increments as described above to virtual constant upward movement. Practical considerations dictate the use of a finite number of incremental adjustments to the position of the conduit. Although two or three incremental stops are used in certain embodiments, it should be understood that the apparatus of this invention contemplates a full range of incremental sequences.

In a preferred embodiment, the fluid dispensing assembly of this invention includes a base having a stanchion extending upwardly and a carriage mounted for movement along the stanchion. A fluid dispensing conduit is mounted for movement with the carriage (multiple fluid dispensing conduits may be so mounted). A control valve, with an actuator, is mounted to the carriage and communicates between a fluid reservoir and the filler lance. The carriage includes one or more sensing mechanisms for actuating signal generators as the carriage moves through the various cycles associated with filling a container.

An arm assembly extends outwardly from the stanchion over a container to be filled and is positioned such that the conduit extends through the outer end of the arm in a guided relationship therewith as the lance is moved with the carriage into and out of a container. The arm assembly preferably includes a wiper ring apparatus for wiping fluid which is collected on the outside surface of the lance as it is withdrawn from a container, as well as a fume disposal sub-assembly which entraps fumes generated by the fluid being introduced into a container and permits them to be drawn away from the area of the filling operation.

According to still another aspect of the invention, the sealing cap installation assembly is located at the end of the assembly line and above the container travel path. This assembly includes a retention assembly comprising a gravity fed bin adapted to contain a plurality of randomly oriented, sealing caps. A retrieval assembly is functionally associated with the retention assembly and serves the purpose of retrieving sealing caps from the retention assembly. The retrieval assembly has a planar rotating member with a sealing cap pick-up mechanism for retrieving the sealing caps, and means for rotating the planar rotating member. An alignment assembly is positioned next to the retrieval assembly and aligns the sealing caps coming from the retrieval assembly. The aligned sealing caps from the alignment assembly are transported by a transport assembly to an installation assembly which functions to install and seal the cap to the top of a bung. The transport assembly includes a gravity fed chute having a central passage sized to permit only one sealing cap at a time to enter the chute. The transport assembly further includes a sensing device for detecting the presence of a sealing cap in the chute. When the sensing device does not detect a cap at the chute exit, a control signal activates the planar rotating member of the retrieval assembly to replenish the supply of caps to the installation assembly.

BRIEF DESCRIPTION OF THE DRAWINGS

FIG. 13 is a perspective view of a retrieval assembly.

FIGS. 14A and 14B are perspective views of a sealing cap in two different orientations on the inlet ramp to the sealing cap installation assembly's gravity fed chute.

FIG. 15 is a perspective view of the sealing cap installation assembly.

DESCRIPTION OF THE PREFERRED EMBODIMENT

Figure 1:
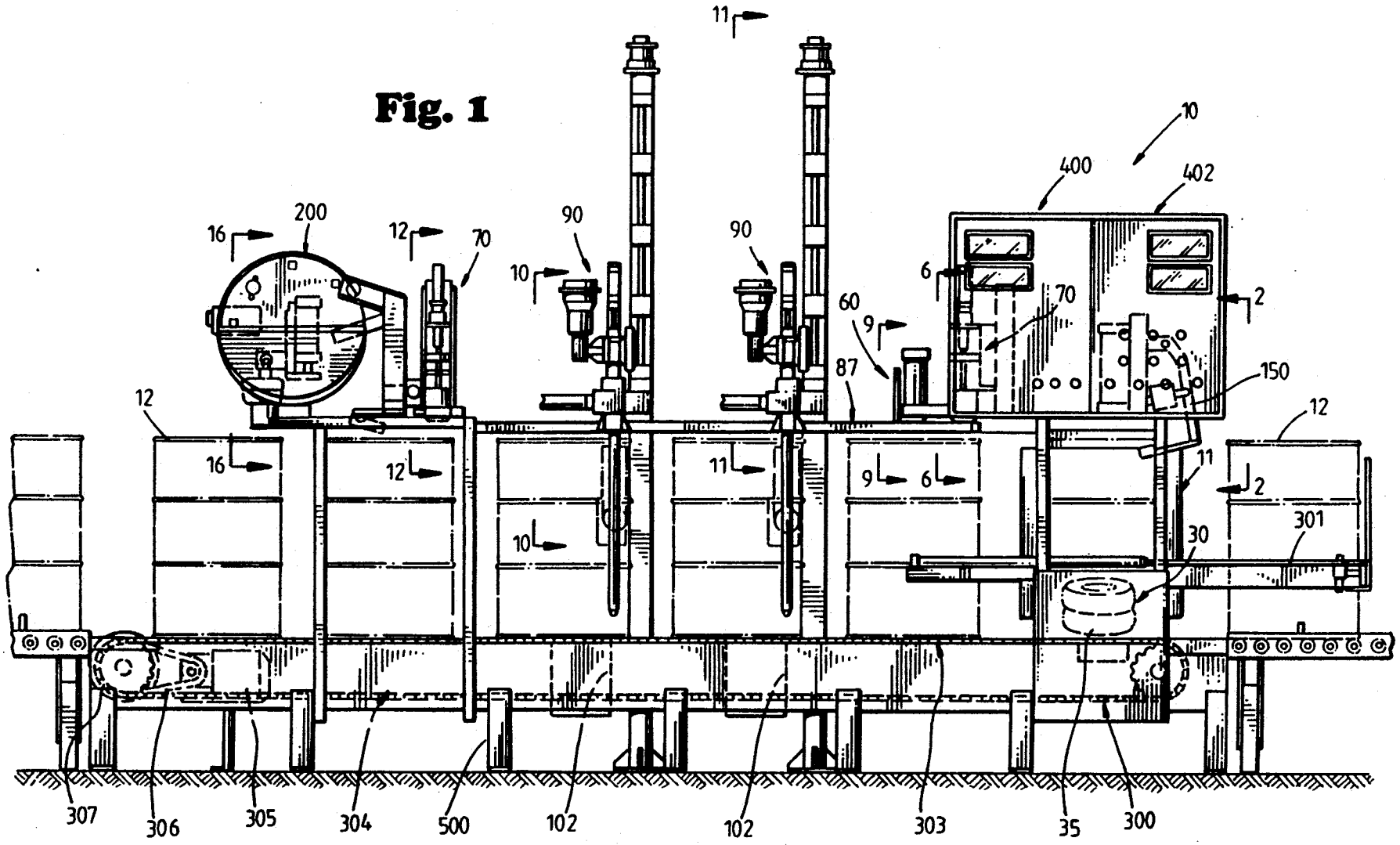
FIG. 1 is a front view of an embodiment of a fluid filling apparatus in accordance with this invention.

Throughout the following description, similar reference numerals refer to similar elements in all Figures of the drawings.

Referring first to FIG. 1, there is shown an automated fluid filling apparatus generally indicated by reference numeral 10 in accordance with the present invention. The filling apparatus 10 is arranged such that it takes the overall form of an automated assembly line. It is particularly well adapted to the filling of relatively large containers 12 (fifty-five gallon drums), that utilize removable, threaded plugs, or bung caps 15, (see FIGS. 2–4) for gaining access into the containers. The bung 14 is characterized by an annular sidewall that extends both below and above the top, or lid, of the container 12.

The filling apparatus 10 is comprised of distinct assemblies which are mounted on a suitable apparatus support structure 500 and oriented such that the assemblies operate on a container 12 in a sequential order as the container 12 is transported between the assemblies by a suitable conveyor means. The apparatus includes a bung alignment assembly 30 for locating and positioning a bung 14 relative to the location of the downstream assemblies which must be properly mated with the bung 14 and the container 12 in order to perform their various tasks.

A kicker assembly 150 is functionally associated with the bung alignment assembly 30 and provides a more precise alignment of the bung 14 which is very effective in increasing overall operating efficiency of the filling apparatus 10. Also included is a bung cap handling assembly 70 for removing the bung cap 15 prior to the actual fluid dispensing step. This same assembly, or a duplicate of it further downstream, can also insert a bung cap 15 into the container 12 after the fluid dispensing step has been completed.

The filling apparatus 10 also includes one or more fluid dispensing assemblies 90 for introducing a predetermined weight of fluid into the container 12. Finally, a sealing cap installation assembly 200 is included for sealing the top of the bung 14 with a sealing cap 20. This cap 20 provides a protective seal which serves to reduce or prevent contamination which may fall into the container 12 when its bung cap 15 is removed, to protect the bung's threaded inner surfaces and to act as a security device to indicate possible tampering with the bung 14 and possible contamination of the contained fluid.

More specifically, a container 12, which is to be filled with a fluid from a source or reservoir (not shown), may be conveyed by manual or mechanical means from a receiving or storage area to the inlet end 11 of the filling apparatus 10. If container 12 is transported to the filling apparatus 10 on a suitable conveyor, then a container spacing means such as the drum rake assembly 301 shown in FIG. 1 may be incorporated to introduce containers 12 from the conveyor to the filling area. The container 12 initially sits on the base 303 of a container transport system 300. This base 303 may, for example, be a conveyor system made up of two trough supported, sprocket chains 304 spaced a distance apart so that they support a container 12 near the outer edges of its bottom surface, drive pulleys 307 and suitable drive assemblies. This arrangement allows a container 12 to be easily rotated about its vertical axis to align its bung 14. Rotation of the drive pulley 307 shown in FIG. 1 in a counter clockwise direction causes the container 12 to move through the filling apparatus and to encounter the assemblies which act in sequential order to perform the various tasks necessary to automatically fill the container 12.

Figure 3:
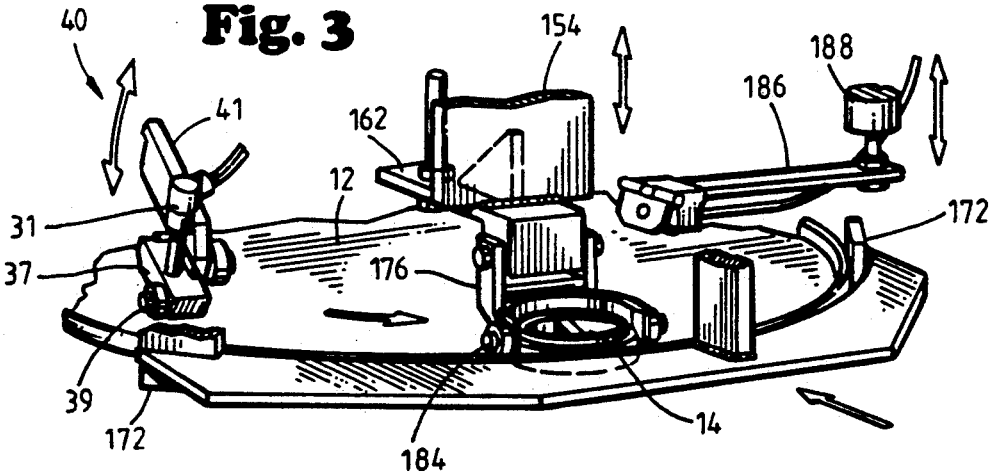
FIG. 3 is a perspective view which shows elements of the kicker assembly and the bung sensing mechanism of the bung alignment assembly.
Figure 4:
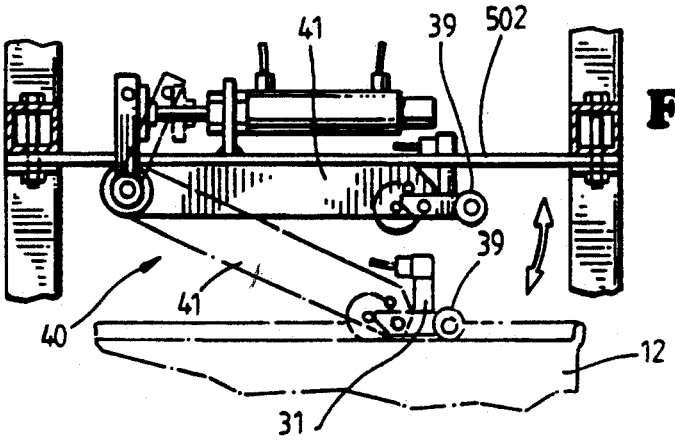
FIG. 4 is a side view of one embodiment of the bung sensing mechanism.
Figure 4A:
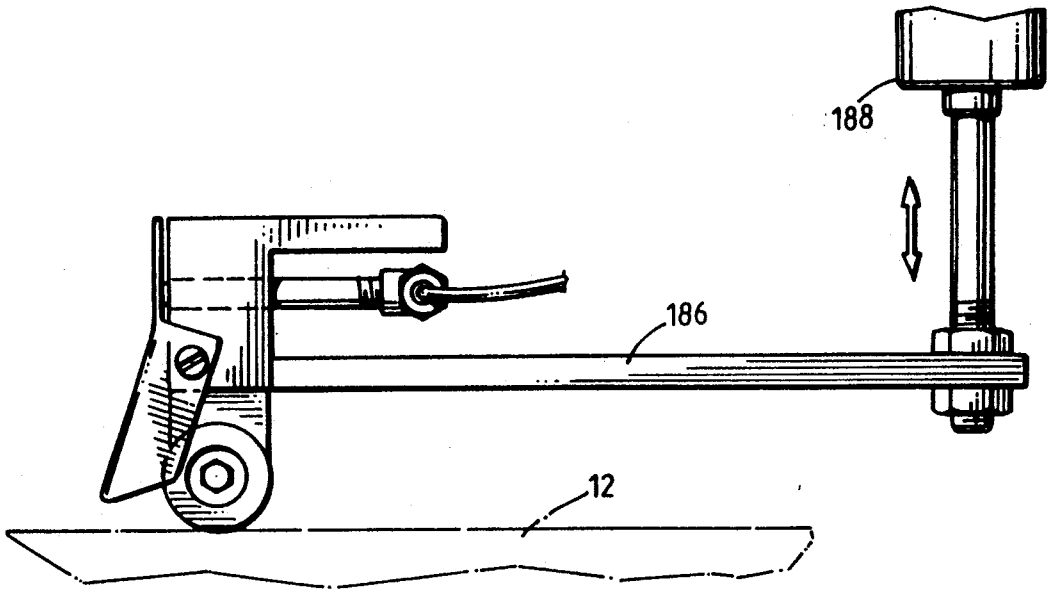
FIG. 4A is a side view of another embodiment of the bung sensing mechanism.
Figure 4B:
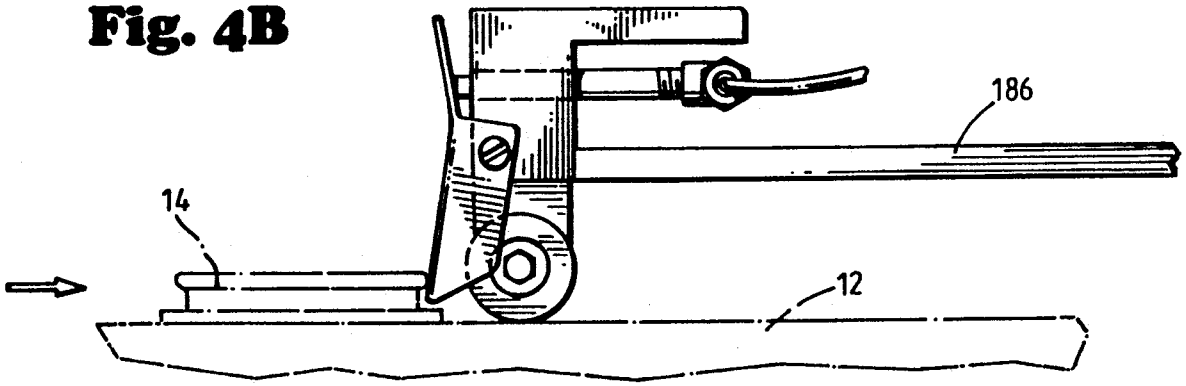
FIG. 4B is a side view of another embodiment of the bung sensing mechanism shown in FIG. 4A as it initially engages the bung.

In moving through the filling apparatus the container initially encounters a bung alignment assembly 30 which includes container rotating means 35, shown in FIG. 1, a bung sensing mechanism 40, shown in FIGS. 3 and 4 and a bung sensor 186 which is also shown in FIG. 3. An embodiment of the alignment assembly may include a roller drive sub-assembly (not shown in its entirety) which is rigidly mounted to a vertical support member. The vertical member is hinged to the lower portion of the apparatus support structure 500. The sub-assembly comprises a rotatably mounted drive shaft which is oriented such that it is parallel with the vertical axis of the container 12. On the shaft is mounted a drive wheel which may be made to contact the lower side regions of the container 12 and impart to it a torquing force sufficient to rotate the container 12 about its vertical axis. This drive sub-assembly may be powered by suitable electrical or mechanical means such as an electric or pneumatic motor which operates in response to control signals from a control mechanism.

To ensure good contact between the drive wheel and the container 12, a set of clamping wheels are located opposite the drive wheel and on the opposite side of the container travel path down the assembly line. The clamping wheels are rotatably mounted on either end of a horizontally mounted arm which is supported from vertical member. The vertical member is rigidly mounted to a horizontal member which is slidably mounted to the base of the support structure 500. A hydraulic piston has its extendable end mounted to the vertical member and its base end rigidly mounted to the base of the support structure 500. The extension and retraction motion of the piston's stroke arm serves to open and close the distance between the drive wheel and the clamping wheels. Also, a second hydraulic piston has its extendable end connected to the hinged vertical member on which the drive wheel is located, and its base end rigidly attached to the lower portion of the support structure 500. Motion of the stroke arm of the piston into an extended position allows the drive wheel to be rotated backward to allow more room for the unobstructed passage of a container 12 between the container rotating means 35 of the apparatus 10. In alternate embodiments of this assembly 30 other rotating means may be used. For example, instead of rotating the container 12 by driven rollers it may also be convenient to rotate the base supporting the container 12.

The bung pre-sensing mechanism 40 shown in FIGS. 3 and 4 is a sensor 31 mounted in a pivoting sensor mount 37. Mount 37 is pivotally attached to the free end of an extension member 41 whose other end is pivotally mounted to a member 501 of the apparatus support structure 500. Rotatably mounted on either of the sensor mount 37 are bearings 39 which ride on the top of any container 12 and holds the sensor mount 37 and is attached to sensor 31 slightly above the top surface of the container 12. The pivotable mounting of the extension member 41 allows the sensor mount 37 to move downward until the sensor mount bearings 39 contact and ride on the top of container 12 which the drum rake assembly 301 positions at the alignment station. The sensor mount 37 rides on the container top along a circle circumscribed by a bung 14 as the container 12 rotates to align its bung 14 for mating with the downstream assemblies. The rotation of the container 12 causes the bung 14 to travel under the sensor 31 which activates the mechanism for terminating the rotational movement of the container 12.

Reference should be made to FIGS. 3, 4, 4A, and 4B. To ensure that the bung does not rotate beyond its desired location, a bung sensor 186 is used. Bung sensor 186 includes a sensing mechanism to terminate rotation of the drum 12 and bung 14. This vertically movable bung sensor 186 includes a horizontal member which is mounted at a right angle from the extendable stroke arm of a vertically oriented hydraulic piston 188. As the stroke arm of the piston is extended, the bung sensor 186 descends so that its centerline contacts the lid of the container with the bung sensor 186 aligned tangent to the previously mentioned circle which is circumscribed by a bung as it is rotated into the proper alignment position. This bung sensor 186 serves to prevent the bung 14 from rotating beyond its desired location. Contact of the bung 14 with the bung sensor 186 generates a signal which causes the bung sensor 186 and the bung sensing mechanism 40, with their tasks now accomplished, to begin to retract to their raised positions.

Figure 5:
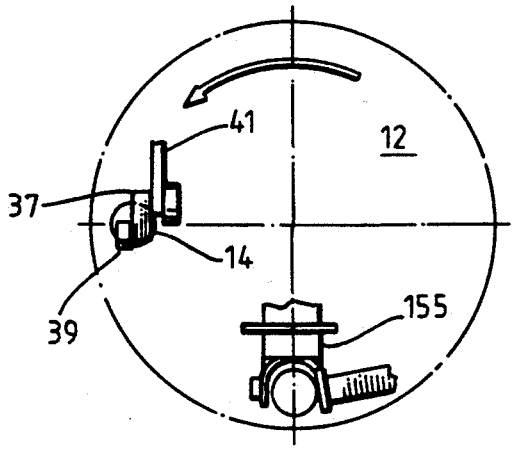
FIG. 5 is a top view of the container showing two different orientations of the container's bung and elements of the kicker assembly.

FIG. 5 shows the situation in which the bung sensing mechanism 40 has been mounted such that an additional ninety degrees is needed to rotate the bung 14 to its desired location, shown as the six o'clock position in this figure where the bung 14 is shown a short time later after it has been engaged by a bung receiving tool 155. Although this preferred embodiment is described as using a mechanical sensor, other commercially available, well-known sensing devices may be used. Examples of other types of devices having utility in this area are: infrared sensors, sonic sensors, photo cells, air jet sensors, mechanical sensors and/or proximity sensors. Each type of sensor has inherent advantages and disadvantages and each is commercially available.

Figure 2:
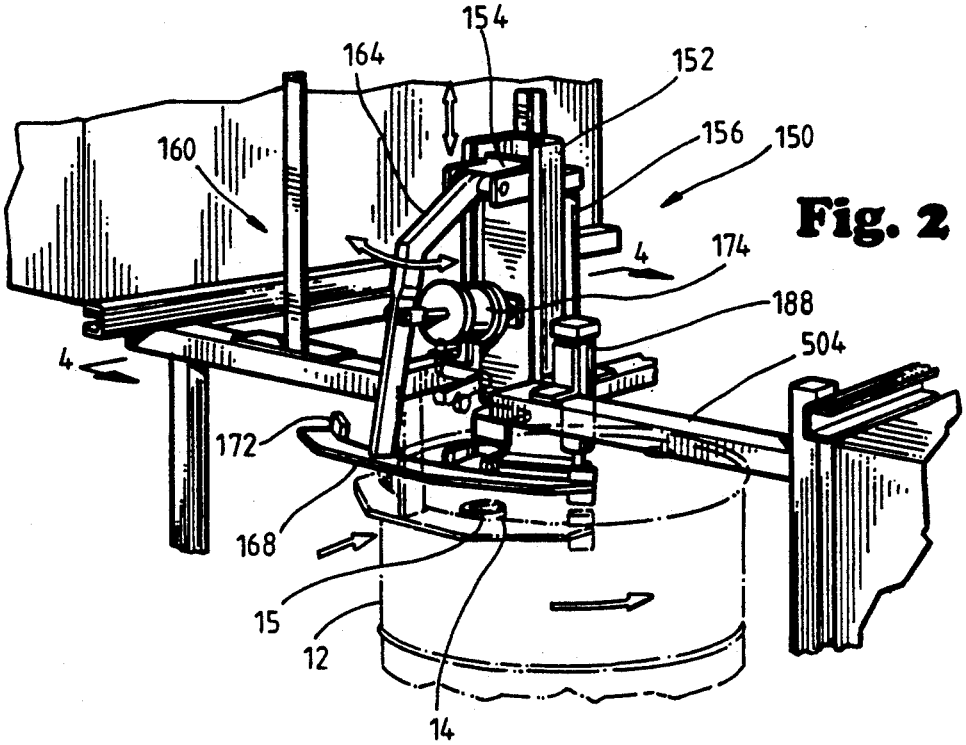
FIG. 2 is a perspective view of the kicker assembly.

This bung alignment assembly 30 operates in conjunction with a kicker assembly 150 to provide a more precise alignment to yield increased overall operating efficiency. The kicker assembly 150 includes a bung receiving tool 155 (FIG. 3) and a container repositioning means 160. FIG. 2 shows a perspective view of an embodiment of the kicker assembly 150. A horizontal member 504 is used to mount the kicker assembly 150 above the container travel path. A vertical, channel beam member 152 is rigidly mounted to this horizontal member 504 and serves as a base and guide for a vertically movable carriage 154. The carriage 154 is slidably mounted at its edges so that it may be raised and lowered in a guide path provided by the channel member 152.

For purposes of this application it should be understood that certain actuating members are described as "hydraulic" or "pneumatic". These are not intended to be limiting characterizations and should be understood to include all types of fluid activated actuating members. The carriage motion is provided by a hydraulic piston 156 which is securely mounted on the back side of the vertical member 152. The free end of the cylinder's stroke arm is attached to the top side of a bracket 162 (FIG. 3) which extends horizontally from the bottom, backside of the carriage 154. Hinged to the top, front side of carriage 154 is a lever arm 164 whose lower end has attached to it a horizontally oriented member 168. This member 168 is configured such that it spreads around the top portions of the container lid. On each end of the horizontal member 168 there is mounted a contact pad 172 such when the horizontal member 168 is allowed to come into close proximity with the container 12, the contact pads 172 are the only points of contact with the container 12. A hydraulic cylinder 174 has its base pivotally mounted to the front side of the carriage 154, while its extendable and retractable free end is mounted near the middle of the lever arm 164.

When the hydraulic cylinder 174 retracts, it causes the horizontal member 168 to move toward and contact the sidewalls of any container 12 that is situated below this assembly 150. At the lower end of the carriage 154 there is hinged a horse shoe shaped, bung receptor bracket 176. This bracket 176 has rotatably mounted on each of the outside edges of its two extending legs a wheel 184. The horseshoe shaped bracket 176 is sized such that the radius of curvature of its inner edge is equivalent to that of the outside radius of the bung 14 that the bracket 176 is to align.

The previously mentioned control signal that causes the drive wheel 38 and the clamping wheels 42 to unclasp the container 12 also causes the kicker assembly 150 to descend into a position in contact with the container 12 such that the center of curvature of the inner edge of the horseshoe shaped bracket 176 is at the point where the bung 14 needs to be in order to be precisely aligned. When the carriage 154 has descended into its lowered position, a control signal actuates the retraction of the hydraulic cylinder 174 free end. This causes the lever arm 164 to move toward and contact the container 12 with its contact pads 172 at two points on the outer edges of the circumference of the container lid.

As the cylinder 174 continues to retract, the contact pads 172 apply to the container 12 an essentially horizontal force which is directed along the container's path of travel. When the container 12 and its bung 14 have moved a short distance, the outer edge of the bung 14 comes into contact with one of the inside edges of the extending legs of the horseshoe shaped bracket 176. With continued applied lateral force, the bung is guided by the horseshoe shaped bracket 176 to assume a position in which the centerline of the bung 14 is at the center of curvature of the inner edge of the bracket 176, and thus precisely aligned.

At this point, the hydraulic cylinder 174 begins to extend its free end so as to raise the lever arm 164 away from the container 12 and to a raised position out of the path of travel of the container 12. When this position is reached, the raising of the carriage 154 is actuated and the release of the bung 14 by the kicker assembly 150. The container 12 and its aligned bung 14 are then free to be transported by the transport assembly 300 to the next work station on the assembly line. Meanwhile, during this intermittent transport period the drum rake assembly 301 assists the container transport assembly in bringing another unaligned container into position to be operated on by the bung alignment 30 and kicker 150 assemblies.

Figure 6:
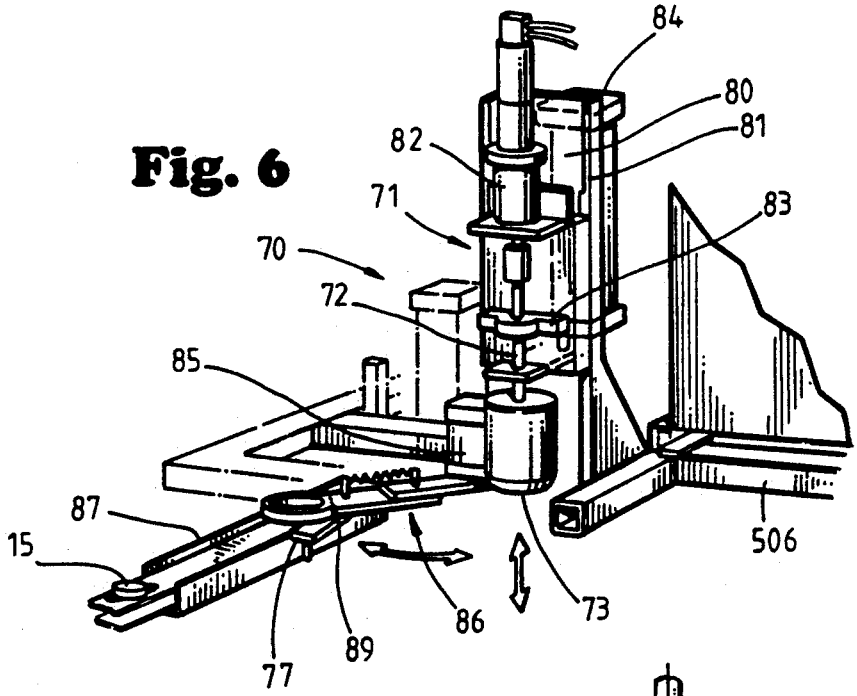
FIG. 6 is a perspective view of the bung cap handling assembly.
Figure 7:
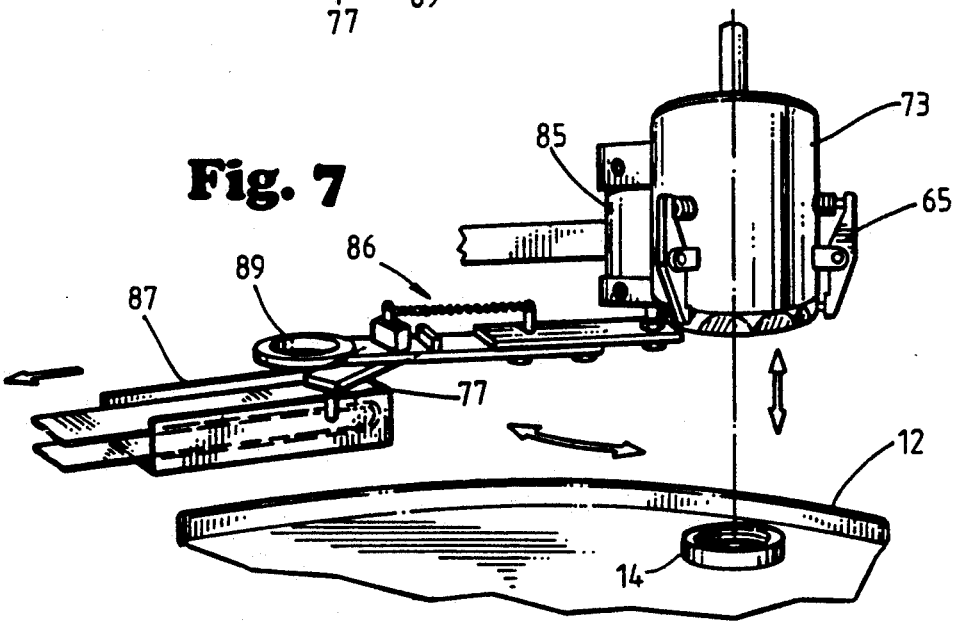
FIG. 7 is a perspective view of the bung cap handling tool and an embodiment of the bung cap retaining means.

The embodiment displayed in FIG. 1 illustrates that the next sequential step in the container filling process is the station where the bung cap 15 is removed by a bung cap handling assembly 70. This assembly comprises a bung cap handling tool 71 and a bung cap transfer arm 86. The bung cap handling tool 71 includes a shaft 72, an alignment housing 73, bung cap retaining means 74 and bung cap engaging means 75 (see FIG. 8). FIGS. 6 and 7 show perspective views of an embodiment of the bung cap handling assembly 70. A horizontal member 506 of the support structure 500 is used to mount the bung cap handling assembly 70 above the container travel path.

This assembly 70 has the ability to be raised and lowered. Thus, in a lowered position the tool 71 can engage the bung 14; and in a raised position the assembly 70 is removed from the container travel path. A vertically oriented shaft 72 is extended from the drive shaft of a vertically aligned motor 82 which is rigidly mounted to a floating tool carriage. The floating carriage is slidably mounted to a lifting carriage 80, which is slidably mounted to a tool carriage guide 81. The tool carriage guide 81 is rigidly mounted to the horizontal member 506. The lifting carriage 80 consists of a rectangular flat plate oriented such that its longer edges travel vertically in grooves which are formed in the sidewalls of the tool carriage guide 81.

Extending from the bottom backside of this lifting carriage 80 is a rigidly mounted bracket whose top surface is horizontally disposed. Rigidly mounted in the center of the top surface of the bracket and vertically disposed is the extendable end of a stroke arm of a hydraulic cylinder 84 that is rigidly mounted to the stationary backside of the tool carriage guide 81. The extension and retraction of the stroke arm provides the motive force for the vertical movement of this assembly 70. A pillow block bearing 83 is mounted to the front side of the floating carriage and is used to stabilize the motion of the tool shaft 72. A rotary actuator 85 is rigidly mounted on a horizontal member of the support structure 500 and oriented such that its drive shaft is oriented downward.

Rigidly mounted and extending perpendicular to this actuator shaft is a bung cap transfer arm 86 which can be rotated in a horizontal plane so that the free end of the arm 86 can be moved underneath the mouth of the bung cap handling tool 71 and receive a bung cap 15 that has been removed from a container 12. The arm 86 can then be rotated in the opposite direction until it assumes a position above a trough 87 into which the bung cap 15 can be dropped. The arm 86 includes a horizontally mounted ring 89 on its free end, with the ring being of a slightly larger diameter than the bung cap 15. Thus, when the bung cap 15 is dropped into the ring 89, the inside surfaces of the ring serve as sidewalls to keep the arm 86 from dropping the bung cap 15.

A spring loaded, rotatably mounted member 77 is positioned below and attached to the arm 86. The member 77 forms a retractable bottom for the ring 89. It has a vertically oriented pin extending below and from the member such that when the ring 89 is moved above the trough 87, the pin strikes the side of the trough and prevents further angular motion of the member 77. The arm itself continues to rotate, thus opening the bottom of the ring so as to drop the bung cap 15 in the trough 87. The trough 87 is aligned in the direction of the container travel path and has in its bottom a small, belt conveyor which can carry the bung cap 15 to a station further downstream where the bung cap 15 may be reinserted into the container 12.

Figure 8:
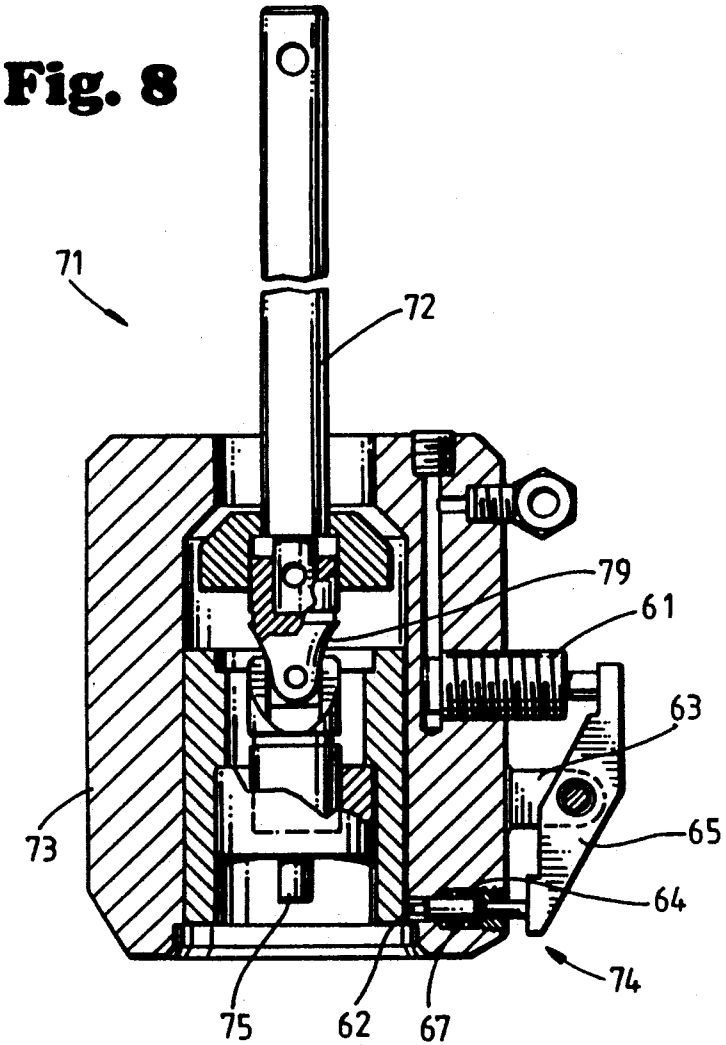
FIG. 8 is a cross sectional view of the bung cap handling tool.

FIG. 8 shows a cross sectional view of a preferred embodiment of the bung cap handling tool 71. It includes a shaft 72, an alignment housing 73, a universal joint 79, bung cap engaging means 75, and bung cap retaining means 74 comprising hydraulically actuated, spring resisted finger pins 67, rocker arms 65, rocker arm mounting brackets 63, pressure driven, slidably mounted rocker arm fittings 61 and a suitable arrangement of hydraulic conduits within and without the alignment housing which connect these parts. The finger pins 67 are slidably mounted in bung cap contact openings 62. Springs 64 mounted in openings 62 and connected to pins 67 bias the pins into their outermost position. Pins 67 abut rocker arms 65. The rocker arms 65 are, in turn, pivotally engaged by rocker arm mounting brackets 63 and abut pressure driven, slidably mounted rocker arm fittings 61.

These fittings are hydraulically connected to the conduits, which in turn are connected to a hydraulic reservoir (not shown). Two finger pins 67 per tool 71 may be used to retain the bung cap 15, but three are preferred. Movement of fitting 61 translates into opposite movement of pins 67 through movement of rocker arms 65. By way of example, when the bung cap 15 is being grasped, pins 67 are positioned inward while fittings 61 are positioned outward. Exactly the opposite is true when the bung cap 15 is released. It will be noted that pneumatic components may be substituted for the hydraulic components of FIG. 8. Alternatives to the bung cap retaining means shown here may involve the use of magnets to engage metallic bung caps 15 and various expansion devices located at the mouth of the alignment housing 73.

Figure 9:
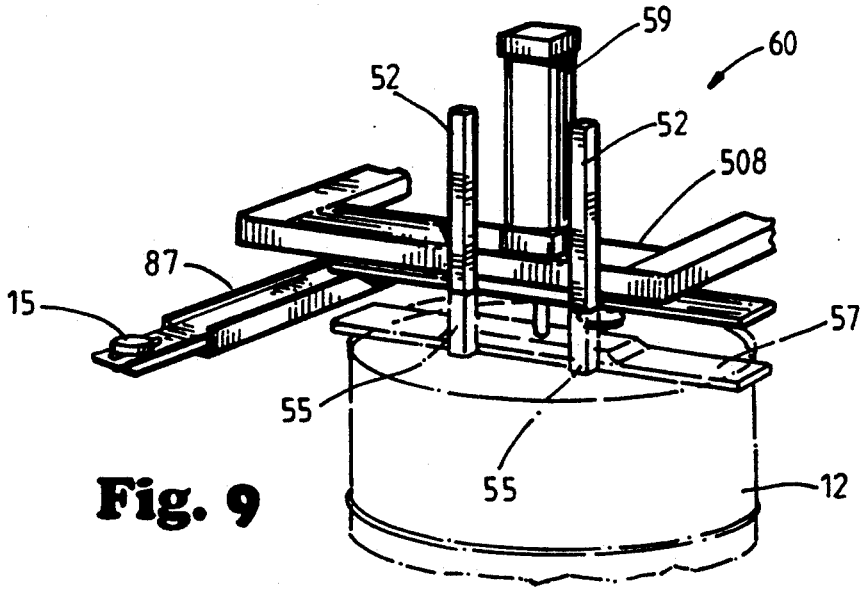
FIG. 9 is a perspective view of a container stabilization mechanism.

Operation of the bung cap handling assembly 70 is actuated by incremental motion of the container transport assembly 300 in locating another container in the precise spot below the assembly 70 so that the centerline of the bung 14 coincides with that of the centerline of the bung cap handling tool 71. At this time, the tool carriage 80 begins to descend until the mouth of the alignment housing 73 comes in contact with the lid of the container 12 in a position such that the housing 73 is encircling the bung 14. Some type of container stabilization mechanism 60 may also be used to lock the container 12 in position so that it doesn't move when the bung cap handling tool 71 exerts the necessary torque on the container 12 to unscrew its bung cap 15. FIG. 9 shows an embodiment of such a container stabilization mechanism 60. Mechanism 60 includes a container contacting, bracing member 57, two vertical guide members 55, two vertical guide tubes 52, and a hydraulic piston 59 which is used to supply the power for the mechanism 60. The piston 59 and vertical guide tubes 52 are rigidly mounted to member 508 of the apparatus support structure 500.

Shortly after the alignment housing 73 contacts the container lid and the engaging means 75 engages the bung cap 15, the motor 82 supplies power to rotate the shaft 72 of the bung cap handling tool 71. The rotation of the shaft 72 causes the bung cap 15 to be unscrewed from the container 12. The bung cap 15 is retained in the housing 73 by the retaining means 74. The alignment housing 73 then rises to a height slightly above the top of the trough 87, and the bung cap swing arm 86 rotates until the ring 89 mounted on its free end is below the mouth of the alignment housing 73. A control signal is generated to cause the bung cap retaining means 74 to release the bung cap 15 which falls into the ring 89. The bung cap swing arm 86 then rotates to a position above the trough 87 into which is dropped the bung cap 15 as a result of the member 77 which serves as its bottom having had its rotational motion stopped by contact between its locator pin and the sidewall of the trough 87. The bung cap handling assembly 70 awaits the arrival of the next container 12 whose bung cap 15 it will remove.

After the bung cap 15 has been removed, a control signal is generated which actuates incremental movement of the container transport assembly 300 to move the container 12 to its next station where it encounters a fluid dispensing assembly 90. Assembly 90 includes a conduit 94, valve 96, weight responsive device 102 (see FIG. 1), a first signal generator, a second signal generator and a signal delay mechanism 100. Previously incorporated by reference and commonly assigned U.S. Pat. No. 4,337,802 gives detailed information on the structure and operation of the assembly 90.

Figure 11:
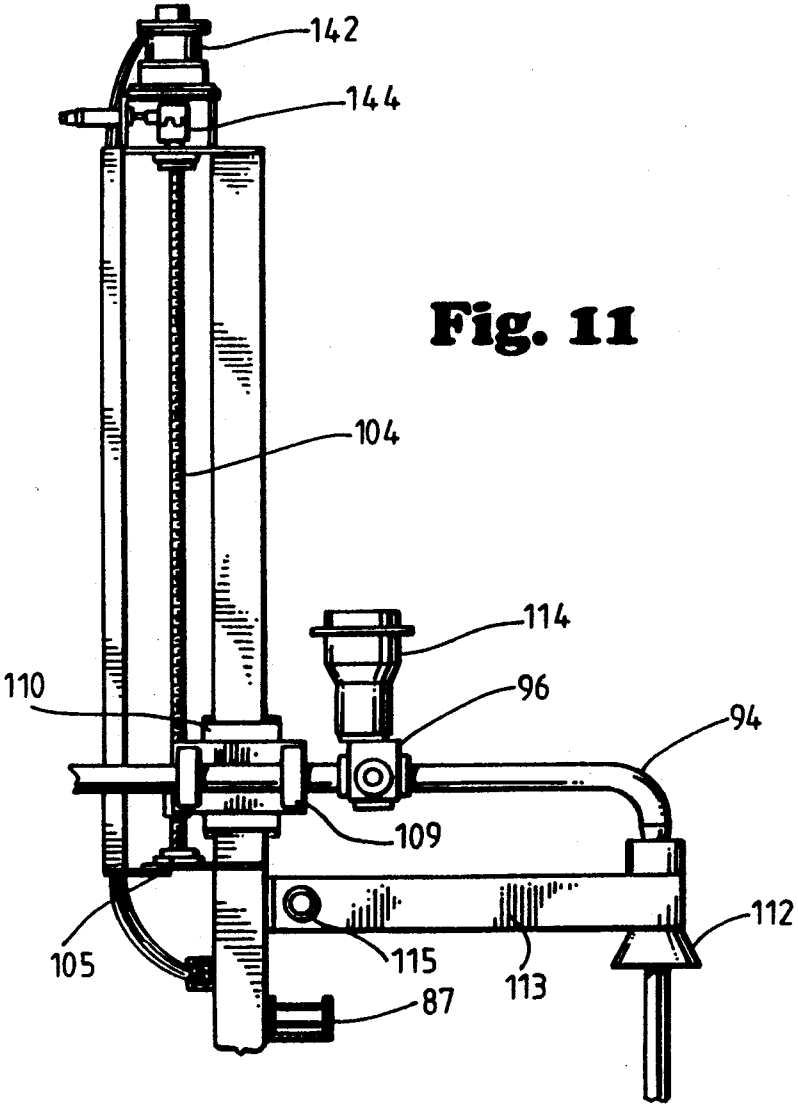
FIG. 11 is a side view of the fluid dispensing assembly.
Figure 10:
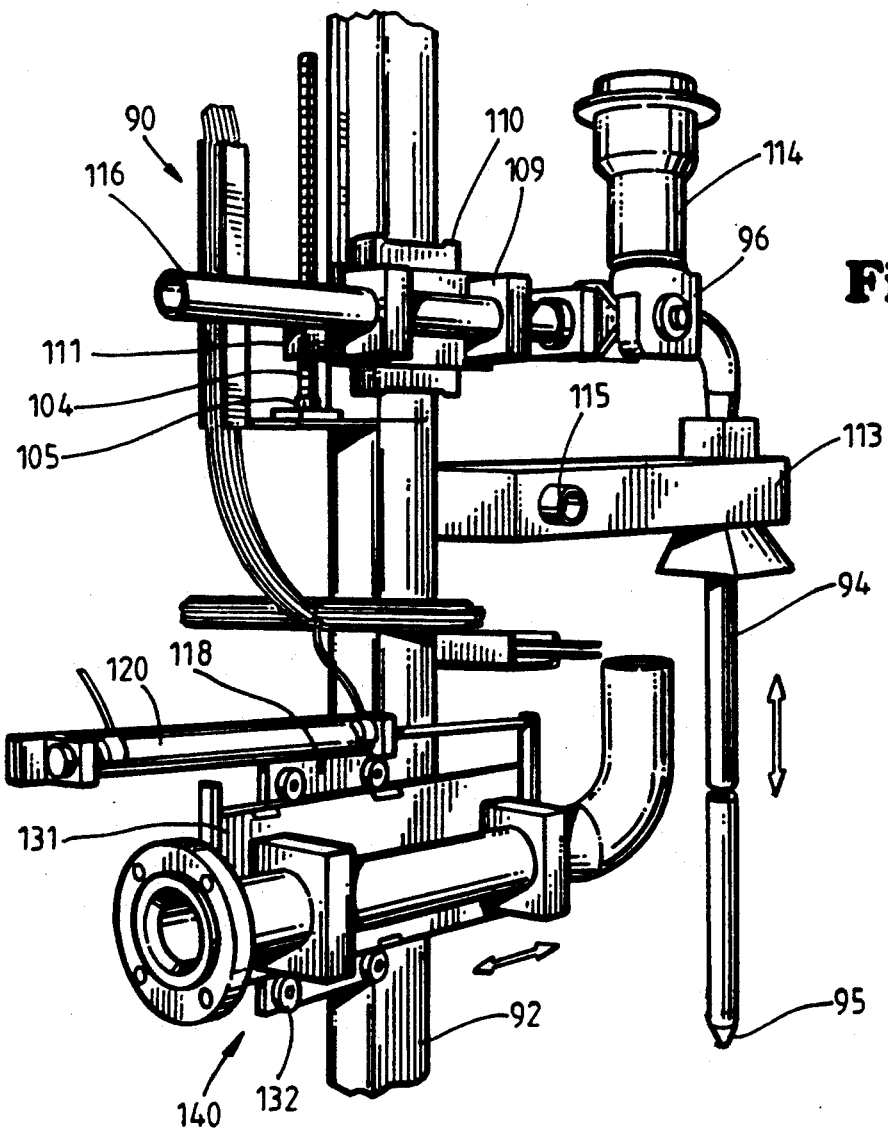
FIG. 10 is a perspective view of the fluid dispensing assembly.

FIGS. 10 and 11 show perspective views of an embodiment of the fluid dispensing assembly 90. A stanchion 92 and a weight responsive device 102 are, as shown in FIG. 1, mounted behind and below, respectively, the container travel path. The stanchion 92 serves as the support member from which to mount the various other elements of the fluid dispensing assembly 90. The height of the member 92 is primarily determined by the requirement that the conduit 94 be movable between raised and lowered positions to enable the fluid dispensing end 95 to be lowered to a position within and near the bottom of the container. This capability is especially advantageous when dealing with toxic, foaming or readily mixing fluids, since safety considerations involved in handling these materials often dictate the use of subsurface filling techniques.

Vertical movability of the conduit 94 is provided by a carriage 110 which is slidably mounted to ride against and on two edges of the upper part of the H-beam shaped stanchion 92. On one edge of the carriage 110 there is rigidly mounted a nut-like block 111, i.e., a ball nut through which a vertically oriented ball screw 104 passes. Rotation of the screw 104 in one direction or another causes the nut-like block 111 and thus the carriage 110 to ascend or descend its path of travel on the edge of the stanchion 92. The lower end of the ball screw 104 is rotatably mounted in a bearing block 105 which is mounted on a bracket rigidly adhered to the side of the stanchion 92. The upper end of the ball screw is secured in a bearing which is also rigidly mounted on the stanchion 92. A coupling 144 connects the ball screw 104 to a downward projecting drive shaft of a motor 142 which supplies power to rotate the screw 104 and thus move the carriage 110. The motor 142 is also rigidly mounted to the stanchion 92. Rigidly secured to the carriage 110 are mounting blocks 109 for supporting the conduit 94.

FIG. 10 shows a conduit 94 which has a ninety degree elbow, so that its dispensing end 95 is oriented vertically downward while its inlet connector pipe 116 is rigidly secured in the mounting blocks 109 and oriented in a horizontal plane. The pipe 116 is used to join the conduit 94 via a suitable, externally supplied piping system to a reservoir of fluid which is to be used in filling the containers 12. Mounted in-line between the carriage 110 and the conduit dispensing end 95 are a fluid flow rate controlling valve 96 and its actuator 114. The valve 96 is used to reduce the container filling time, while also reducing the potential for safety problems due to fluid splashing, foaming and mixing with the surrounding environment. Valve 96 controls fluid flow so that fluid initially enters the container 12 at a slow or dribble flow rate until the conduit's dispensing end 95 is submerged in fluid; the valve 96 then switches to a fast flow rate until the container 12 is practically filled. At this time, the valve 96 again regulates fluid flow back to a slower rate, and finally shuts off the flow of fluid when the container 12 is completely filled.

Also shown in FIGS. 10 and 11 is a fume hood 112, a connecting hood exhaust ductwork 113 and a ductwork outlet 115 to which an external suction source is connected. The conduit 94 can be seen to be encircled by the fume hood 112 while its exhaust ductwork is rigidly mounted to the stanchion.

When using fluid filling apparatus 10 it is sometimes desirable to quickly switch and fill the containers with different types of possibly incompatible fluids. In such instances, it is advantageous to be able quickly purge the fluid dispensing assembly 90. This capability is provided by the purge assembly 140 shown in FIG. 10. It comprises a conduit receiving pipe 130 which has mounted at its receiving end a suitable hydraulic connector for providing a seal around the conduit 94 when its dispensing end 95 is inserted in the pipe 130. The receiving end of the pipe 130 is oriented vertically to receive the conduit 94, and it uses a ninety degree elbow to allow its outlet end to be directed in a horizontal plane for mating via a suitable connector to discharge the purging fluid in a suitable reservoir.

The pipe 130 is movable in the horizontal plane between positions which place its receiving end either beneath and aligned with the dispensing end 95 or in a retracted, storage position located closer to the stanchion 92. The pipe 130 is securely mounted via suitable mounting blocks on a purge carriage 131 which is a rectangular plate oriented in the vertical plane with its longest sides directed horizontally. Clamping wheels 132 ride on suitable guides which are located on these sides. The wheels 132 are rotatably mounted on a mounting plate 118 which is rigidly attached to the side of the stanchion 92. Motion of the purge carriage 131 is provided by a hydraulic cylinder 120 which is rigidly mounted to the mounting plate 118 and oriented so that its stroke arm is aligned with the desired direction of travel of the carriage 131.

The free end of the cylinder stroke arm is connected to a rigid member which extends from the carriage 131 and serves to transfer the driving force of the piston to the carriage 131. The carriage 131 responds by moving between the clamping wheels 132 which hold the carriage 131 to its mounting plate 118. As the cylinder stroke arm is extended the carriage 131 moves toward the conduit 94 until the receiving end of the pipe 130 is aligned with the dispensing end 95 of the conduit 94. When the cylinder stroke arm is retracted, it returns the pipe 130 to its storage position.

A signal from the control mechanism for the drum filling operation initiates rising of the locator pads 104 of the weight responsive device 102 located beneath the container 12, as it sits on the container transport assembly 300 beneath the descending conduit 94. The pads 104 contact the bottom of the container and suspend it so that its weight may be continually measured by the scale 102 shown in FIG. 1. Incremental motion of the container transport assembly 300 in locating a container 12 below the conduit 94 of the fluid dispensing assembly 90 and above the weight responsive device 102 actuates the assembly 90. A first signal generator 98 generates a control signal which causes the carriage 110 to descend the stanchion and thereby lower the conduit 94 into the container 12 until its dispensing end 95 is just above the bottom of the container 12.

The sequencing of the actuation of the filling lance and related subassemblies is an important feature of this invention. The specific sequencing may be determined by the particular fluid being used or the equipment being used. In one embodiment of this invention a single filling lance is used, while in a more preferred and more complex embodiment of this invention two or more filling lances are used. The use of two or more filling lances and attendant filling stations permits a number of options in the filling process. First, the multiple stations may be used to place the same fluid into the same drum in a sequential filling operation. A second option is to place two different fluids in the same drums at different filling stations. A third option is to place the same or different fluids into the same drum but under different conditions of pressure, foaming, or other characteristics which might affect the fluid material.

In operation of the container filling apparatus of this invention all operations are typically controlled by weight. In the preferred embodiment there are two filling stations, each of the filling station with its own scale. In this preferred embodiment the container is partially filled at the first station and then topped off at the second station. The two stations are referred to respectively as the bulk fill station and trim fill station.

To achieve the true net weight of the filled container, the weight of the empty container, called the tare weight, must first be determined. When a container is indexed to the bulk fill station, the weight plate raises and the tare weight is determined. The tare weight is stored in a temporary register for later use by the trim filling station. Before the filing lance descends in the bulk fill station, the tare weight is substracted from the gross weight on the scale. Since the drum is empty this effectively sets the scale to zero. At this point in the filling operation, the bulk fill lance descends and the bulk filling sequence begins.

At the conclusion of the bulk fill sequence, the tare weight is transferred to the trim fill station, the bulk fill lance retracts and the partially full container is transferred to the trim filling station. The trim filling station weigh plate raises and the gross weight of the partially filled drum is determined. The tare weight is then substracted from the gross weight to achieve the current net weight. This weight corresponds to the fluid depth in the partially filled container. The trim fill lance then lowers to a point below the surface of the fluid and the trim fill cycle begins. The filling sequence is completed when the net weight of the container reaches a predetermined value.

In the preferred sequence of operations in the practice of this invention, the weight plate raises the drum into the filling position and checks the weight of the drum. The filling lance is then lowered to near the bottom of the drum. A bottom limit switch at the bottom of the carriage guide is then actuated to permit the slow fill mode. When a predetermined weight is reached a fast fill cycle is initiated. As the fast fill cycle continues and fluid is injected in to the container, the filling lance is moved upwardly portionate to the weight of the material in the container. When the desired weight of material is close to being completed, the slow fill cycle is again initiated and the filling lance stops its upward movement. The slow fill cycle is continued until the desired net weight has been achieved. At that time the filling lance is raised to its upper limit and out of the container.

In another embodiment of this invention described in commonly assigned U.S. Pat. No. 4,494,583 the following sequence occurs. When the conduit 94 reaches its lowered position, a second signal generator 99 signals the valve actuator 114 to open the valve 96 and provide an initial slow or dribble flow rate. A delay mechanism 100 continues this initial slow flow rate for a preset interval long enough for the dispensing end 95 to be immersed in the fluid. The delay mechanism 100 then generates a control signal which causes the valve 96 (described in U.S. Pat. No. 4,494,583) to yield a fast fluid flow rate. This fast flow rate continues until the weight of the fluid in the container 12 reaches a first cut-off weight. At this time the weight responsive device 102, as embodied by the scale 102 shown in FIG. 1, generates its first control signal. Typically, this first control signal may be generated when about 90% of the desired fluid weight has been achieved. The first control signal actuates the motor 142 to rotate the ball screw 104 such that the carriage 110 and conduit 94 are lifted from their lowered position.

When the carriage 110 begins to rise, the signal to the fluid flow rate controlling valve 96 is interrupted, thus causing shut off of the fast flow rate into the container 12. Once the conduit 94 has reached its raised position within the container 12, a second interval of slow fluid flow rate begins and continues until a second cut-off weight is reached. When the second cut-off weight is reached, the flow of fluid shuts off and the conduit 94 is raised to its standby position above and out of the way of the travel path of the containers 12. When the conduit 94 reaches this raised position, the container transport assembly 300 is again activated to move the filled container 12 to the next downstream work station, while delivering another empty container 12 to the location beneath the fluid dispensing assembly 90.

It can be noted that the embodiment of the apparatus 10 shown in FIG. 1 displays two fluid dispensing assemblies 90 located at adjacent work stations. This configuration may be employed, when it is desired to reduce the time required for the fluid dispensing step. This situation may arise, for example, when this step is the most time consuming of the various steps involved in the total filling operation, thereby limiting the overall rate of production. When utilizing two fluid dispensing assemblies, the control methodology is modified so that the action of the first assembly is to fill only half the container, while the second assembly extends its conduit only to the mid-height of the container and completes the fluid dispensing step.

Figure 16:
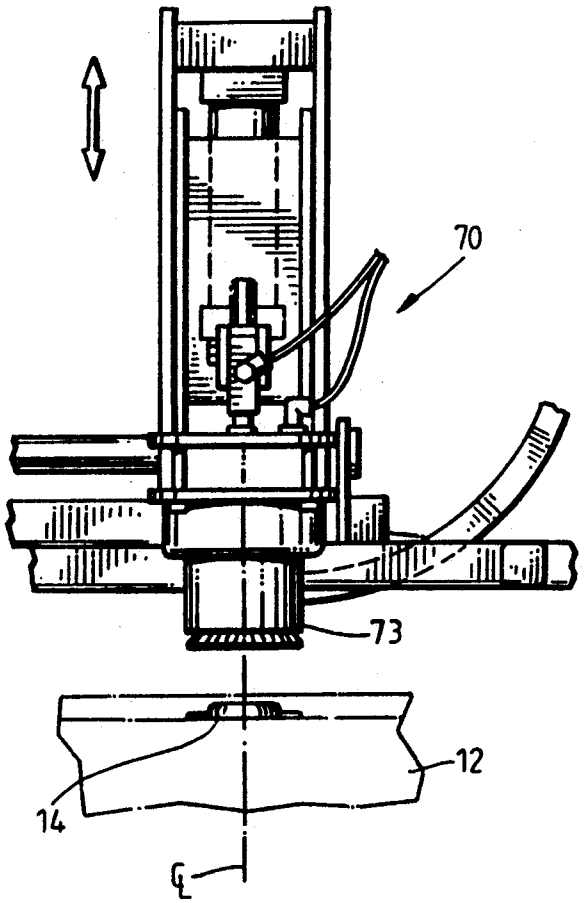
FIG. 16 is a side view of the sealing cap installation assembly.
Figure 12:
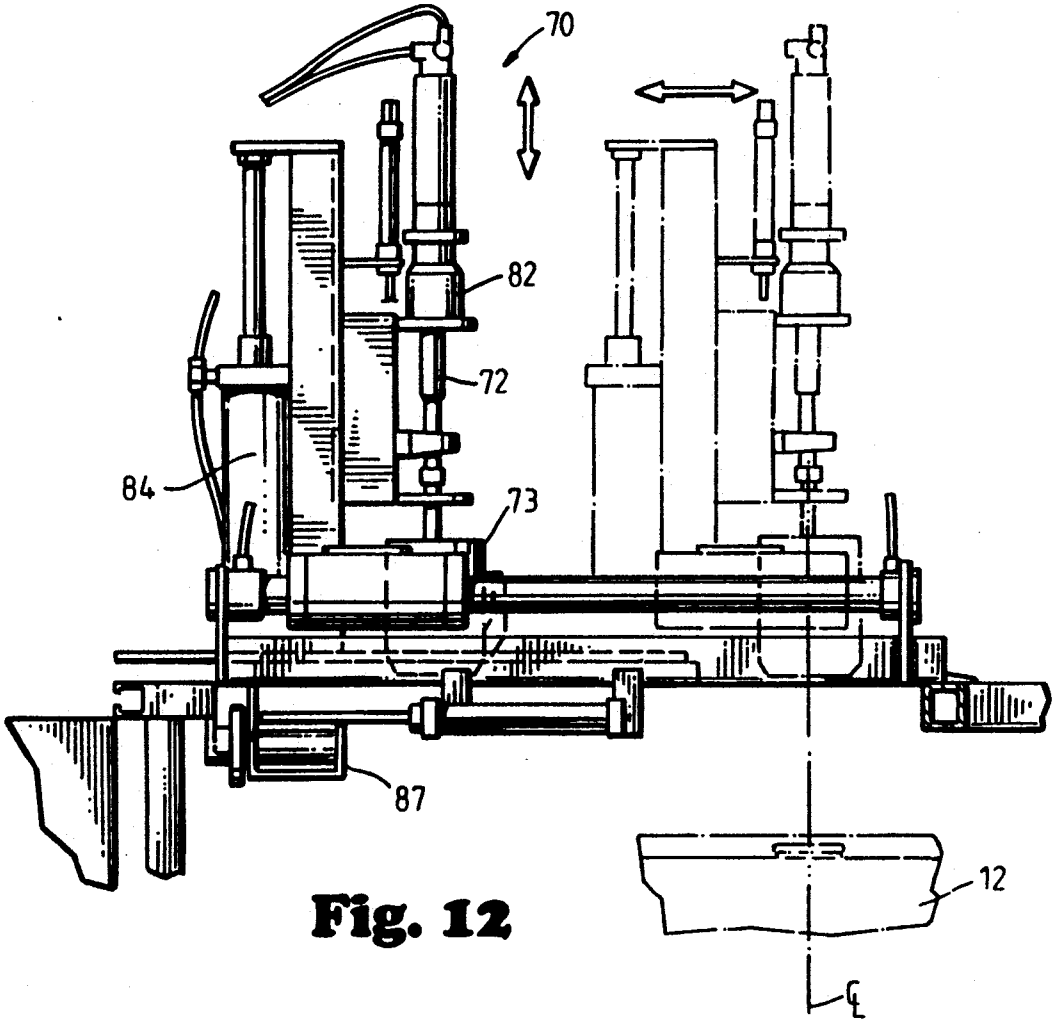
FIG. 12 is a side view of a bung cap handling assembly so mounted as to be used for reinserting a bung cap into a container.

After the fluid dispensing step, the container 12 is moved by the container transport assembly 300 to the next downstream work station where a bung cap 15 is reinserted into the container 12. The assembly for accomplishing this step is essentially identical to the previously described bung cap handling assembly 70, except for its orientation and mounting. These differences are shown by the embodiment displayed in FIGS. 12 and 16. In this bung cap reinsertion embodiment, the bung cap handling assembly 70 has been rotated ninety degrees and mounted such that it has transverse, horizontal motion. The bung cap swing arm 86 has been eliminated in favor of having the alignment housing 73 pick up the bung caps 15 directly from the trough 87. As previously seen, a carriage, guide rail and hydraulic piston assembly are used to enable the assembly 70 to be positioned at either above the trough 87 or above the filled container 12 into which a bung cap 15 is to be inserted.

Upon completion of the bung cap 15 reinsertion step, the container transport assembly is again activated to move the container 12 to its final downstream work station where a sealing cap 20 is placed over the bung 14. This step is accomplished by a sealing cap installation assembly 200, an embodiment of which is shown in FIGS. 13, 14A, 14B and 15. The assembly 200 includes a retention assembly 201, a retrieval assembly 203, an alignment assembly 205 and a transport assembly 207, and is described in detail in the commonly assigned and previously incorporated by reference, U.S. patent application Ser. No. 07/901,807.

The retention assembly 201 is mounted above the container path of travel on horizontal members 510 and 512 of the apparatus support structure 500. The retention assembly 201 includes a gravity fed bin 220 adapted to contain multiple sealing caps 20 in random configuration. The gravity fed bin 220 includes a bottom surface 222 which is sloped downward and inward so as to direct the sealing cap 20 toward a retrieval assembly 203. This assembly 203 is associated with the retention assembly 201 and adapted to retrieve one or more of the sealing caps 20 from the retention assembly. The retrieval assembly 203 includes a planar rotating member 224 which may be activated by various suitable means, such as by motor 226. The planar rotating member 224 forms one side of the gravity fed bin 220 and includes attachment means, such as magnets 228, attached thereto for retrieving one or more sealing caps 20 from the gravity fed bin 220. As the rotating member 224 rotates, sealing caps 20 adhere to the magnets 228 and are drawn from the gravity fed bin 220.

The retrieval assembly 203 further includes mechanical limiting means, such as arms 230, for limiting retrieval of sealing caps 20 to one at a time and for returning the additional sealing caps 20 to the retention assembly 201. The arms 230 are parallel to the rotating member 224 and positioned a preselected distance from the face of the rotating member 224. Thus, when more than one sealing cap 20 becomes attached to a magnet 228, the cap 20 that is immediately adjacent to the arm 230 remains adhered to the magnet; the other sealing caps 20 contact the arm 230 and are knocked back into the gravity fed bin 220.

An alignment assembly 205 is associated with, and positioned adjacent to, the retrieval assembly 203 to accept sealing caps 20 from the retrieval assembly 203 and to align the caps 20. The alignment assembly 205 includes a gravity fed ramp 232 which transfers properly aligned sealing caps 20 from the retrieval assembly 203 to a transport assembly 207. Improperly aligned sealing caps 20 go back to the retention assembly 201. The gravity fed ramp 232 is preferably approximately parallel to the rotating member 224 and includes a flange 234 which extends upward from the ramp 232 on the side of the ramp 232 nearest the rotating member 224. Sealing caps 20 have flanges 22 which contact a joint 236 between the ramp 232 and the flange 234 if the caps 20 are improperly aligned. This causes the sealing caps 20 to fall off the ramp 232 onto a return chute 238 where they are directed back into the gravity fed bin 220. Properly aligned sealing caps 20 roll down ramp 232 to the transport assembly 207.

The transport assembly 207 is associated with the alignment assembly 205 to accept sealing caps 20 from the alignment assembly 205 and to guide the sealing caps 20 to a bung sealing location. The transport assembly 207 includes a gravity fed chute 240 having a central passage 242 sized to permit only one properly aligned sealing cap 20 to enter the chute 240 at one time. The transport assembly 207 includes a control system 244 which in turn includes a sensing device 246 for detecting the presence of sealing caps 20 in the gravity fed chute 240. When the sensing device 246 detects the presence of sealing caps 20 in the chute 240, this information is relayed to the control system.

The control system 244 then generates a signal that is relayed to motor 226 which activates or deactivates rotating member 224, depending upon whether a sealing cap 20 has been detected in the chute 240. A gating assembly 250 is associated with the transport assembly 207. The gating assembly 250 is positioned near the bottom of the transport assembly 207 and includes a gate chute 252 to receive the sealing caps 20 from the bottom 254 of the gravity fed chute 252 and to direct the sealing caps 20 to a bung sealing location 256. The gating assembly 250 further includes a gating mechanism 258 which is operable between a first position and a second position. In the first position, the gating mechanism 258 is closed and prevents any sealing caps 20 from exiting the gate chute 252. When a container 12 passes beneath the gating assembly 250, the gating mechanism 258 is activated to a second position thereby allowing a single sealing cap 20 to exit the gating chute 252 and be deposited on the bung 14 of the container 12. The gating mechanism 258 may be activated by various suitable means, such as by a beam of light. The container and sealing cap 20 are then transported to the final work station where the flange 22 of the sealing cap 20 is crimped, with a commercially available crimper, into place to secure the sealing cap 20 to the bung 14. As with some of the other assemblies, the crimper is mounted with a suitable carriage, guide rail and hydraulic piston sub-assembly to allow it to vertically move between an upper, out of the way storage position and a lower, work position where it contacts the now covered bung 14 and crimps the sealing cap 20 into place. From this point, the containers 12 exit this fluid filling apparatus 10.

Having described the preferred embodiment of the invention, those skilled in the art may effect numerous modifications thereto in view of the foregoing description. It is, however, understood that such modifications lie within the contemplation and scope of this invention as defined in the appended claims.

What is claimed is:

1. An automated, fluid filling apparatus for introducing a fluid into a container having a bung opening comprising:

(a) a fluid dispensing assembly for dispensing fluid into said container;

(b) a bung alignment assembly for locating and positioning the bung of said container relative to said fluid dispensing assembly, said bung alignment assembly being functionally interconnected with said fluid dispensing assembly;

(c) a kicker assembly functionally associated with said bung alignment assembly for applying necessary positional adjustments to said container to yield precise alignment of said container relative to said fluid dispensing assembly;

(d) a bung cap handling assembly for removing a bung cap from said bung prior to a fluid dispensing operation and for inserting a bung cap into said bung after the fluid dispensing operation has been completed;

(e) a sealing cap installation assembly for sealing the top of said bung with a sealing cap after filling of said container and insertion of said bung cap into said bung; and (f) an apparatus control system associated with said assemblies, said apparatus control system comprising means for controlling the interaction of said container and said assemblies to sequentially align said bung, remove said bung cap, dispense fluid, reinsert a bung cap and seal said bung.

2. The fluid filling apparatus of claim 1 further comprising a container transport assembly for moving said container relative to the locations of said assemblies.

3. The fluid filling apparatus of claim 1 further comprising a power source capable of sequentially operating:

(a) said bung alignment assembly for locating and positioning the bung of said container relative to a fluid dispensing assembly;

(b) said kicker assembly for applying necessary positional adjustments to said container to yield precise alignment of said container relative to said fluid dispensing assembly;

(c) said bung cap handling assembly for removing a bung cap from said bung prior to a fluid dispensing operation;

(d) said fluid dispensing assembly for dispensing fluid into said container;

(e) said second bung cap handling assembly for reinserting a bung cap into said bung after the fluid dispensing operation has been completed; and (f) said sealing cap installation assembly for sealing the top of said bung with a sealing cap after filling of said container and insertion of said bung cap into said bung.

4. The fluid filling apparatus of claim 1 wherein said bung alignment assembly includes:

a container rotating means for rotating said container to align said bung with said bung cap handling assembly; and a bung sensing mechanism for detecting the position of said bung relative to said fluid dispensing assembly, said bung sensing mechanism being operable in cooperation with said container rotating means.

5. The fluid filling apparatus of claim 1 wherein said kicker assembly includes:

a bung receiving tool serving as a guide to be used in repositioning said container into precise alignment with said fluid dispensing assembly; and container repositioning means, functionally associated with said bung receiving tool, for applying to said container the motive force necessary to cause said container's bung to contact and be guided by said bung receiving tool into a position yielding precise alignment of said bung with said fluid dispensing assembly.

6. The fluid filling apparatus of claim 1 wherein said bung cap handling assembly includes:

a bung cap handling tool, said tool being movable between raised and lowered positions, said tool having a shaft, an alignment housing mounted on said shaft, bung cap retaining means mounted on said alignment housing for attaching said alignment housing to said bung cap, bung cap engaging means mounted on the distal end of said shaft for removing said bung cap from said container prior to the fluid dispensing operation and for inserting a bung cap into said container after the fluid dispensing operation has been completed; and a bung cap transfer arm for receiving said bung cap form said bung cap handling tool and repositioning said bung cap so that it may be transported along with said container to a different location where said bung cap will be reinserted into said container.

7. The fluid filling apparatus of claim 1 wherein said fluid dispensing assembly includes:

a conduit for linking said container with a fluid reservoir to provide a fluid passageway for introducing fluid into said container, said conduit being movable between raised and lowered positions;

a valve for controlling the rate of fluid flow through said conduit and into said container;

a first signal generator for generating a first control signal to initiate movement of said conduit from a raised position to a lowered position;

a second signal generator actuatable by movement of said conduit towards a lowered position, for generating a second control signal to actuate said valve to commence a slow fluid flow rate into said container;

a delay mechanism actuatable by said second control signal to trigger a fast fluid flow rate into said container after an initial predetermined delay interval; and a weight responsive device adapted to generate a first weight and a second weight control signal when the weight of said fluid in said container equals a predetermined first and a second cut-off weight, said first weight control signal being operable to initiate withdrawal of said conduit towards a raised position and to actuate said valve to return to a slow fluid flow rate into said container, and said second weight control signal being operable to initiate termination of fluid flow from said conduit and the movement of said conduit to a raised position.

8. The fluid filling apparatus of claim 1 wherein said sealing cap installation assembly includes:

a retention assembly comprising a gravity fed bin adapted to contain a plurality of randomly oriented, sealing caps;

a retrieval assembly for retrieving sealing caps from said retention assembly, said retrieval assembly having a planar rotating member with a sealing cap pick-up mechanism for retrieving a sealing cap from said retention assembly, and means for rotating said planar rotating member;

an alignment assembly for accepting said sealing caps from said retrieval assembly and aligning said sealing caps;

a transport system for transporting said aligned sealing caps from said alignment assembly to a crimping assembly; and a crimping assembly for positioning and sealing a sealing cap over the top of said bung.

9. An automated, fluid filling apparatus for introducing a fluid into a container having a bung opening comprising:

(a) a fluid dispensing assembly for dispensing fluid into said container;

(b) a bung alignment assembly for locating and positioning the bung of said container relative to said fluid dispensing assembly, said bung alignment assembly being functionally interconnected with said fluid dispensing assembly;

(c) a kicker assembly functionally associated with said bung alignment assembly for applying necessary positional adjustments to said container to yield precise alignment of said container relative to said fluid dispensing assembly, said kicker assembly including a bung receiving tool serving as a guide to be used in repositioning said container into precise alignment with said fluid dispensing assembly; and a container repositioning means, functionally associated with said bung receiving tool, for applying to said container the motive force necessary to cause said container's bung to contact and be guided by said bung receiving tool into a position yielding precise alignment of said bung with said fluid dispensing assembly;

(d) a bung cap handling assembly for removing a bung cap from said bung prior to a fluid dispensing operation and for inserting a bung cap into said bung after the fluid dispensing operation has been completed;

(e) a sealing cap installation assembly for sealing the top of said bung with a sealing cap after filling of said container and insertion of said bung cap into said bung;

(f) an apparatus control system associated with said assemblies, said apparatus control system comprising means for controlling the interaction of said container and said assemblies to sequentially align said bung, remove said bung cap, dispense fluid, reinsert a bung cap and seal said bung; and (g) a container transport assembly for moving said container relative to the locations of said assemblies.

10. The fluid filling apparatus of claim 9 wherein said bung alignment assembly includes:

a container rotating means for rotating said container to align said bung with said bung cap handling assembly; and a bung sensing mechanism for detecting the position of said bung relative to said fluid filling assembly, said bung sensing mechanism being operable in cooperation with said container rotating means.

11. The fluid filling apparatus of claim 9 wherein said bung cap handling assembly includes:

a bung cap handling tool, said tool being movable between raised and lowered positions, said tool having a shaft, an alignment housing mounted on said shaft, bung cap retaining means mounted on said housing for attaching said alignment housing to said bung cap, bung cap engaging means mounted on the distal end of said shaft for removing said bung cap from said container prior to the fluid dispensing operation and for inserting a bung cap into said container after the fluid dispensing operation has been completed; and a bung cap transfer arm for receiving said bung cap from said bung cap handling tool and repositioning said bung cap so that it may be transferred along with said container to a different location where said bung cap will be reinserted into said container.

12. The fluid filling apparatus of claim 9 wherein said fluid dispensing assembly includes:

a conduit for linking said container with a fluid reservoir to provide a fluid passageway for introducing fluid into said container, said conduit being movable between raised and lowered positions;

a valve for controlling the rate of fluid flow through said conduit and into said container;

a first signal generator for generating a first control signal to initiate movement of said conduit from a raised position to a lowered position;

a second signal generator actuatable by movement of said conduit towards a lowered position, for generating a second control signal to actuate said valve to commence a slow fluid flow rate into said container;

a delay mechanism actuatable by said second control signal to trigger a fast fluid flow rate into said container after an initial predetermined delay interval; and a weight responsive device adapted to generate a first weight and a second weight control signal when the weight of said fluid in said container equals a predetermined first and a second cut-off weight, said first weight control signal being operable to initiate withdrawal of said conduit towards a raised position and to actuate said valve to return to its said slow fluid flow rate into said container, and said second weight control signal being operable to initiate termination of fluid flow from said conduit and the movement of said conduit to a raised position.

13. The fluid filling apparatus of claim 9 wherein said sealing cap installation assembly includes:

a retention assembly comprising a gravity fed bin adapted to contain a plurality of randomly oriented, sealing caps;

a retrieval assembly for retrieving sealing caps from said retention assembly, said retrieval assembly having a planar rotating member with a sealing cap pick-up mechanism for retrieving a sealing cap from said retention assembly, and means for rotating said planar rotating member;

an alignment assembly for accepting said sealing caps from said retrieval assembly and aligning said sealing caps;

a transport system for transporting said aligned sealing caps from said alignment assembly to a crimping assembly; and a crimping assembly for positioning and sealing a sealing cap over the top of said bung.

14. The fluid filling apparatus of claim 9 further comprising a power source capable of sequentially operating:

(a) said bung alignment assembly for locating and positioning the bung of said container relative to a fluid dispensing assembly;

(b) said kicker assembly for applying necessary positional adjustments to said container to yield precise alignment of said container relative to said fluid dispensing assembly;

(c) said bung cap handling assembly for removing a bung cap from said bung prior to a fluid dispensing operation;

(d) said fluid dispensing assembly for dispensing fluid into said container;

(e) said second bung cap handling assembly for reinserting a bung cap into said bung after the fluid dispensing operation has been completed; and (f) said sealing cap installation assembly for sealing the top of said bung with a sealing cap after filling of said container and insertion of said bung cap into said bung.

15. An improved fluid filling apparatus for filling a container having a bung and a bung cap, the apparatus being of the type having a conduit for linking said container with a fluid reservoir to provide a fluid passageway for introducing fluid into said container, said conduit being movable between a raised and a lowered position; a valve for controlling the rate of fluid flow through said conduit and into said container; a first signal generator for generating a first control signal to initiate movement of said conduit from its raised position to its lowered position; a second signal generator actuatable by movement of said conduit towards its lowered position for generating a second control signal to actuate said valve to commence flow of fluid at a slow rate into said container; a delay mechanism actuatable by said second control signal to trigger a fast flow rate of fluid into said container after an initial predetermined delay interval; a weight responsive device adapted to generate a first weight and a second weight control signal when the weight of said fluid in said container equals a predetermined first and a second cut-off weight, said first weight control signal being operable to initiate withdrawal of said conduit towards its raised position and to actuate said valve to return to its said slow flow rate of fluid into said container, and said second weight control signal being operable to initiate termination of fluid flow from said conduit and the movement of said conduit to its raised position; and a container rotating means for rotating said container to align a bung of said container with said conduit; wherein the improvement comprises:

(a) a bung sensing mechanism, operable in cooperation with said container rotating means for detecting the position of said bung relative to said conduit;

(b) a container rotating means control system for operating said container rotating means;

(c) a bung cap handling tool, said tool being movable between raised and lowered positions, said tool having a shaft, an alignment housing inserted on said shaft, tool attachment means for attaching said tool to said bung and bung cap engaging means mounted on the distal end of said shaft for removing said bung cap from said container prior to a fluid dispensing operation and for inserting a bung cap into said container after the fluid dispensing operation has been completed;

(d) a kicker assembly for applying necessary positional adjustments to said container to yield precise alignment of said container relative to said fluid dispensing assembly;

(e) a sealing cap retention assembly comprising a gravity fed bin adapted to contain a plurality of randomly oriented sealing caps, said sealing caps being used for sealing the top of said bung after filling of said container and insertion of said bung cap into said bung;

(f) a sealing cap retrieval assembly for retrieving sealing caps from said sealing cap retention assembly, said sealing cap retrieval assembly having a planar rotating member with a sealing cap pick-up mechanism for retrieving a sealing cap from said sealing cap retention assembly, and means for rotating said planar rotating member;

(g) a sealing cap alignment assembly for accepting said sealing caps from said sealing cap retrieval assembly and aligning said sealing caps;

(h) a sealing cap transport assembly for transporting said aligned sealing caps from said sealing cap alignment assembly to a sealing cap installation assembly; and (i) a sealing cap installation assembly for positioning and sealing a sealing cap over the top of said bung of said container.

16. The fluid apparatus of claim 15 further comprising an apparatus control system associated with said assemblies, said apparatus control system comprising means for controlling the interaction of said container and said assemblies to sequentially align said bung, remove said bung cap, dispense fluid, reinsert a bung cap and seal said bung.

17. The fluid filling apparatus of claim 15 further comprising a container transport assembly for moving said container relative to the locations of said assemblies.

18. A method of automatically filling a container having a bung and a bung cap with a predetermined weight of fluid, comprising the steps of:

(a) rotating said container to provide a gross alignment of said bung with a bung cap handling assembly;

(b) applying necessary positional adjustments to said container to yield precise alignment of said container and its bung relative to said bung cap handling assembly;

(c) removing said bung cap from said container with said bung cap handling assembly;

(d) actuating the movement of the dispensing end of a conduit from a raised position to a predetermined position inside and just above the bottom of said container, said conduit providing a fluid transport passage for said fluid from a reservoir to the interior region of said container;

(e) introducing a fluid into said container at a slow flow rate for a predetermined initial time interval until said dispensing end of said conduit is submerged in said fluid;

(f) increasing to a fast flow rate said fluid's introduction into said container;

(g) continuing to introduce said fluid into said container until a predetermined first cut-off weight of said fluid in said container is achieved;

(h) withdrawing said dispensing end of said conduit from said container at an extraction rate such that said dispensing end remains at a uniform distance below the rising free surface of said fluid being introduced into said container;

(i) decreasing to a slow flow rate said fluid's introduction into said container when the weight of said fluid in said container achieves said first cut-off weight;

(j) initiating full shut-off of said fluid's introduction into said container and final withdrawal of said conduit to its raised position when a predetermined final cut-off weight of said fluid in said container is achieved;

(k) inserting a bung cap into said container after the fluid dispensing filling operation has been completed; and (l) sealing the top of said bung with a sealing cap.

* * * * *